US006514034B2

(12) United States Patent
Okamura et al.

(10) Patent No.: US 6,514,034 B2
(45) Date of Patent: Feb. 4, 2003

(54) PUMP

(75) Inventors: Tomoyoshi Okamura, Minori (JP); Kouichi Irie, Tsuchiura (JP); Taiji Hashimoto, Tsuchiura (JP); Hitoharu Kimura, Chiyoda (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/826,872

(22) Filed: Apr. 6, 2001

(65) Prior Publication Data

US 2002/0164245 A1 Nov. 7, 2002

(51) Int. Cl.[7] ..... F04D 3/00
(52) U.S. Cl. ..... 415/58.5; 415/173.1; 415/208.2
(58) Field of Search ..... 415/58.4, 58.5, 415/173.1, 198.1, 199.4, 199.5, 191, 208.2, 914

(56) References Cited

U.S. PATENT DOCUMENTS

| | | | | | |
|---|---|---|---|---|---|
| 3,193,185 | A | * | 7/1965 | Erwin et al. | 415/193 |
| 3,482,520 | A | * | 12/1969 | Larsen | 261/87 |
| 3,620,639 | A | * | 11/1971 | Gaffal | 376/282 |
| 4,212,585 | A | | 7/1980 | Swarden | 415/58.6 |
| 4,871,294 | A | * | 10/1989 | Ivanov et al. | 415/58.4 |
| 4,990,053 | A | * | 2/1991 | Rohne | 415/143 |
| 5,125,799 | A | | 6/1992 | Sato et al. | 416/178 |
| 5,385,447 | A | * | 1/1995 | Geister | 415/208.2 |
| 6,302,643 | B1 | * | 10/2001 | Kurokawa et al. | 415/119 |

FOREIGN PATENT DOCUMENTS

| | | | | |
|---|---|---|---|---|
| DE | 180723 | | 12/1905 | |
| EP | 1069315 | | 1/2001 | |
| JP | 60050298 | A * | 3/1985 | F04D/29/44 |
| JP | 6123298 | | 5/1994 | |
| NL | 6409459 | | 2/1966 | |

OTHER PUBLICATIONS

New Passive Device To Suppress Several Instabilities In Turbomachines by Use of J–Grooves, Osaka Nov. 1–6, 1998, Kurokawa et al.

Innovative Device To Suppress Performance–Curve Instability In A Mixed Flow Pump By Use of J–Groove, Saha et al.

Suppression of Performance Curve Instability of A Mixed Flow Pump By Us of J–Groove, Saha et al, vol. 122, Sep. 2000 transactions of the ASME.

Passive Control of Rotating Stall In A Parallel–Wall Vaneless Diffuser by Radial Grooves, Kurokawa et al, vol. 122, Mar. 2000 Transactions by ASME.

* cited by examiner

*Primary Examiner*—Edward K. Look
*Assistant Examiner*—Richard A. Edgar
(74) *Attorney, Agent, or Firm*—Antonelli, Terry, Stout & Kraus, LLP

(57) ABSTRACT

A pump, comprising: an impeller 1 having blades; and a casing 121 for storing the impeller therein, on an inner surface of which, confronting to the impeller, are formed plural numbers of shallow grooves 124 in a direction of pressure gradient of fluid, around a periphery thereof, wherein the fluid being increased up in pressure by the blades 122 flows within the grooves in a reverse direction, directing to an upstream side, so as to spout out at a place where re-circulations occur when the flow rate is low in amount. Also, an outlet angle of the blade 122 is set to be within a region from 30 degree to 90 degree. Further, preferably, front guide vanes 11 are provided, so that a direction of absolute flow at an outlet of the impeller is directed into an axial direction of the pump at an amount of designed flow rate.

13 Claims, 8 Drawing Sheets

FIG. 5(a)
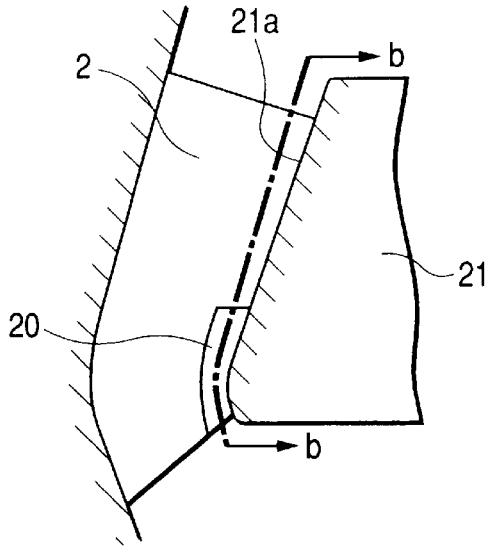
FIG. 5(b)
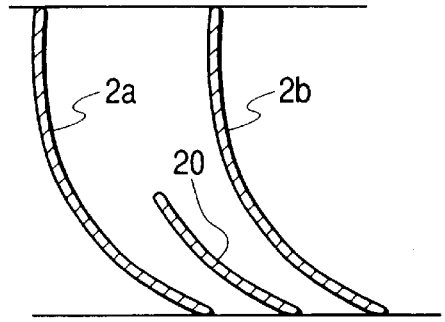
FIG. 6(a)
PRIOR ART
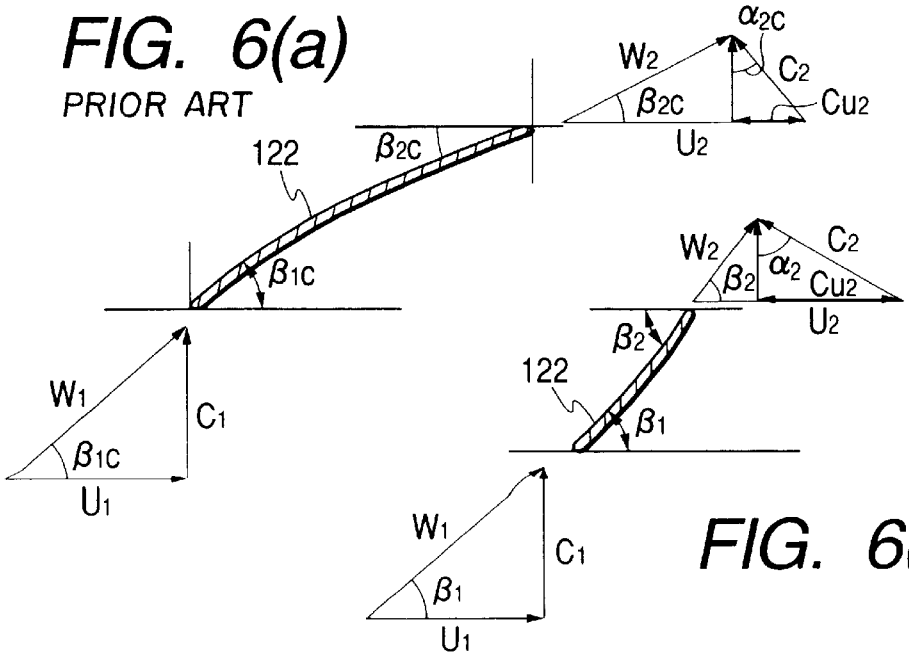
FIG. 6(b)

PUMP

BACKGROUND OF THE INVENTION

The present invention relates to a pump having a non-voluminous type impeller, and in particular relates to small-sizing of the pump.

Small-sizing of a pump enables the manufacturer thereof to reduce manufacturing costs, as well as other costs for transportation and installation thereof. It is also advantageous for a customer, i.e., a user of the pump, since it enables to reduce in an area of the place where the pump is set up, and also to reduce the costs for constructing a pump station. Accordingly, the requirement for small-sizing of the pump is important for both the manufacturer and customer. For achieving such the requirement, it is well known that increase in revolution number of an impeller is effective, i.e., bringing it to operate at high speed.

As other means, it is also considered to set up or establish an output angle of blades of the impeller to be large, for the small-sizing of the pump by reducing an outer diameter of the impeller, while still satisfying a total pump head and a delivery amount for the same specification, but without increase of the pump revolution number.

Further, a technology of this kind according to the conventional art is disclosed, for example, in Japanese Patent Laying-Open No. Hei 6-123298 (1994).

However, for obtaining such the small-sizing of the pump by increasing up the revolution number of the impeller, i.e., high speed of the impeller, it is necessary to design the shape of blades and the configuration of flow passages, so as to generate less cavitations in the pump (i.e., an improvement on the performances in relation with cavitations), and it is very difficult in practice to solve the problem therewith.

On the other hand, for obtaining small-sizing of the pump while keeping the pump revolution number at the same by setting up the outlet angle of blades to be large, while still satisfying the total head and the delivery amount for the same specification, there are the following problems. Namely, the load rises upper unit length of blades when the outlet angle thereof is made large, and there is a tendency that an unstable portion appears remarkably on the head curve due to separation and/or stalls in a region of low flow rate. In this unstable portion, since there exist two (2) or more operating points for the pump, the delivery amount is shifted between those points; therefore there is a problem that stable operation is impossible therein.

BRIEF SUMMARY OF THE INVENTION

An object, therefore, according to the present invention, is to provide a pump which can be small-sized without the necessity of increasing the revolution number of the impeller, while suppressing the unstable portion from appearing on the head curve due to the separation and/or stalls within the region of low flow rate.

For achieving the above-mentioned object, according to the present invention, there is provided a pump, comprising: an impeller having blades; and a casing for storing said impeller therein, on an inner surface of which, confronting to said impeller, are formed plural numbers of grooves in a direction of pressure gradient of fluid, around a periphery thereof, for connecting between an inlet side of blades and an area on the inner surface of said casing where the blades exist, wherein, an outlet angle of the blade, being measured from a peripheral direction of the blade of said impeller, is set to be within a region from 30 degree to 90 degree.

Herein, according to the present invention, it is preferable in the pump as defined above, to set up said outlet angle of the blade within a region from 50 degree to 70 degree.

Further, according to the present invention, it is advantageous in the pump as defined above, to provide rear guide vanes in plural numbers thereof around a periphery of a hub which is provided the outlet side of said impeller, and to provide intermediate vanes on a surface of said hub, having a height being equal to or less than one-third (⅓) of that of the rear guide vanes, between said rear guide vanes.

And, according to the present invention, it is especially effective, when the pump as defined above is applied into a vertical shaft pump having a flow passage forming portion which is constructed with a pump casing and a delivery bent, and a pump shaft, which penetrates through said delivery bent vertically and is attached with the impeller at a lower side thereof.

In a case of applying the pump as defined above into the vertical shaft pump, it is possible to dispose plural numbers of bearings on said delivery bent in a vertical direction thereof, for supporting said pump shaft, and to construct an attachment portion of said impeller onto the pump shaft and said bearing at a lowest portion, so that a distance between them is larger than that between said bearing at the lowest portion and two (2) pieces of said bearings at a most upper portion.

Further, it is also possible to construct the pump as defined above, further comprising a hub provided at an outlet side of said impeller, and rear guide vanes provided on the hub, wherein said impeller, said hub, said rear guide vanes and said delivery bent are assembled together in one body as a hydraulic power portion, and being so constructed, that said hydraulic power portion can be assembled with or disassembled from the flow passage forming member which is constructed with the pump casing and the delivery bent, by inserting said hydraulic power portion into said flow passage forming member from above.

Another feature, according to the present invention, there is provided a pump, comprising: a casing; an impeller having plural numbers of blades, being provided within said casing; and plural numbers of grooves, which are provided on an inner surface of said casing, connecting between an inlet side of said impeller and an area on the inner surface of said casing where the blades exist, wherein, front guide vanes are provided in said casing at an upstream side of said impeller, and said front guide vanes are so set up, that a direction of absolute flow at an outlet of said impeller is directed into an axial direction of the pump at an amount of designed flow rate. In this manner, according to the present invention, it is preferable to set up the outlet angle of said blades at a value being equal or greater than 30 degree.

Another feature, according to the present invention, there is provided a pump comprising: a casing; an impeller having plural numbers of blades, being provided within said casing; and plural numbers of grooves, which are provided on an inner surface of said casing, connecting between an inlet side of said impeller and an area on the inner surface of said casing where the blades exist, wherein, said grooves are formed to be equal or greater than 5 mm in depth thereof, while to be smaller than the depth in width of said grooves; and an outlet angle of the blade is set to be within a region from 30 degree to 90 degree.

It is advantageous in the pump as defined above, to form said grooves being provided around a periphery of said casing in the plural number thereof, so that a total of the widths of said grooves is from about 30% to 50% with respect to a peripheral length on the inner surface of said casing, where said grooves exist, while the depth of said grooves is equal or greater than 2 mm, so as to be from about 0.5% to 1.6% of an inner diameter of said casing where said grooves exist.

Further, as another feature according to the present invention, there is provided a vertical shaft pump, comprising: a pump casing; an impeller having plural numbers of blades, being provided within said casing; a delivery bent disposed in a downstream side of said pump casing; a pump shaft, penetrating through said delivery bent vertically and being attached with the impeller at a lower side thereof; and plural numbers of grooves, which are provided on an inner surface of said casing, connecting between an inlet side of said impeller and an area on the inner surface of said casing where the blades exist, wherein said grooves are formed to be equal or greater than 5 mm in depth thereof, while to be smaller than the depth in width of said grooves; an outlet angle of the blade is set to be within a region from 30 degree to 90 degree; and said delivery bent is formed in an oval shape in cross-section thereof, in which difference between inner and outer diameters of a curvature is smaller than width of a flow passage therein, on a cross-section in vicinity of the curvature of said flow passage.

Herein, according to the present invention, in the vertical shaft pump as defined above, a shape on the cross-section of said delivery bent is a circular shape on the cross-section at an inlet side and an outlet side thereof. Also, according to the present invention, it is desirable in the vertical shaft pump as defined in the above, to set up width h of the flow passage in a curvature radial direction Rb of said bent tube to establish following relationship with respect to width W of the flow passage in a direction perpendicular to a plane of the curvature (a direction perpendicular to the radius direction Rb), in a cross-sectional shape of said delivery bent on a cross-section, in vicinity of a center of the curvature of the flow passage thereof $W=(1.3\sim2.0)h$. Furthermore, according to the present invention, it is advantageous in the vertical shaft pump as defined in the above, wherein cross-section area of the flow passage on a cross-section to set up said delivery bent in vicinity of a center of the curvature of the flow passage thereof to be as from 1.0 time to 1.2 times large as cross-section area at an inlet portion of said delivery bent. And, according to the present invention, also it is advantageous in the vertical shaft pump as defined above, to form plural numbers of grooves on an inner wall surface of said delivery bent in a direction of main flow therein.

BRIEF DESCRIPTION OF SEVERAL VIEWS OF DRAWINGS

Figure 2:
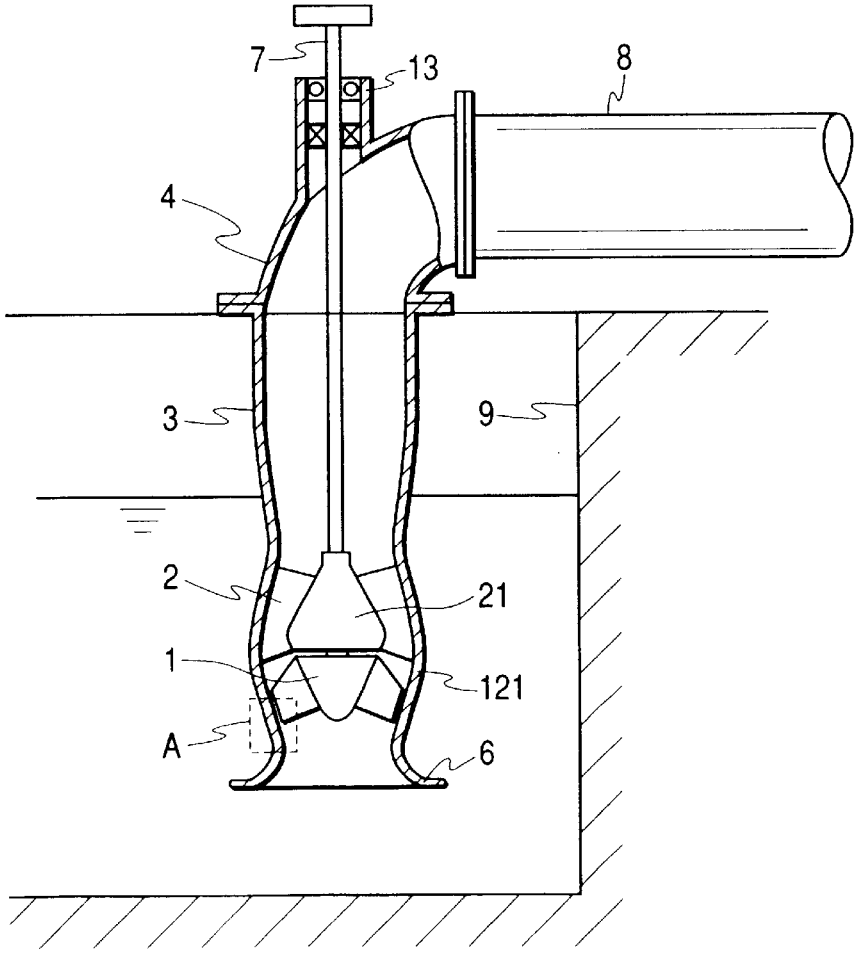
FIG. 2 is a view for showing the structure of a typical vertical shaft mixed-flow pump, which is applied into a drainage pump, etc.
Figure 7:
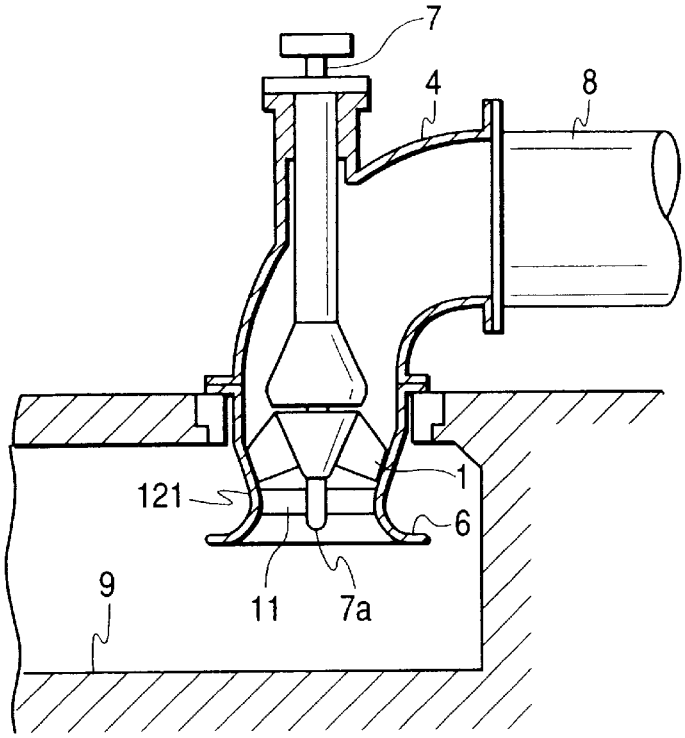
Figure 8A:
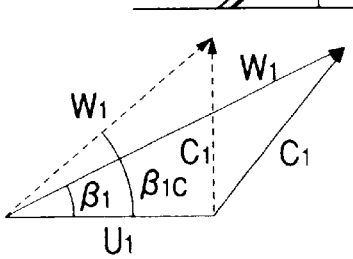
Figure 8B:
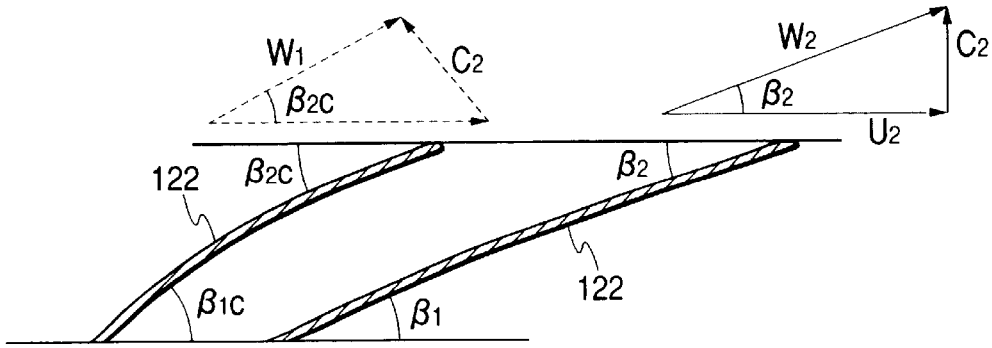
Figure 9A:
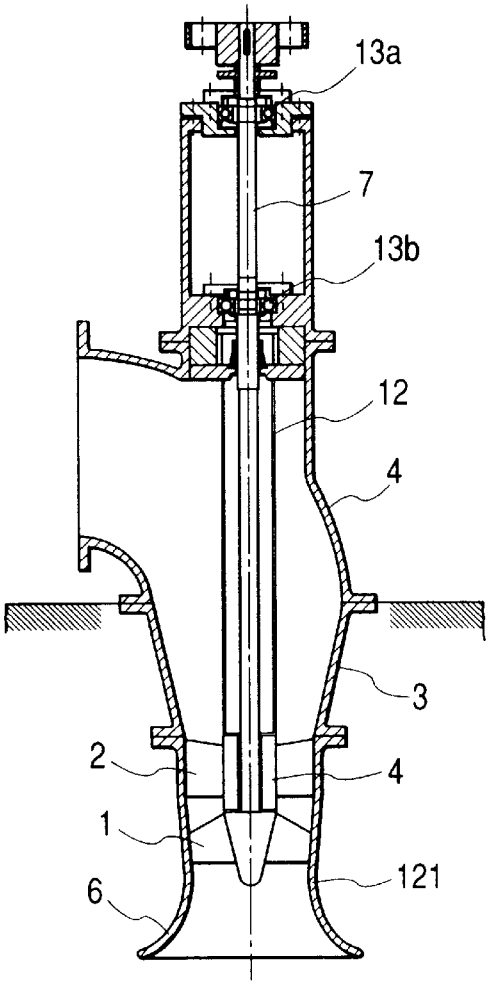
Figure 9B:
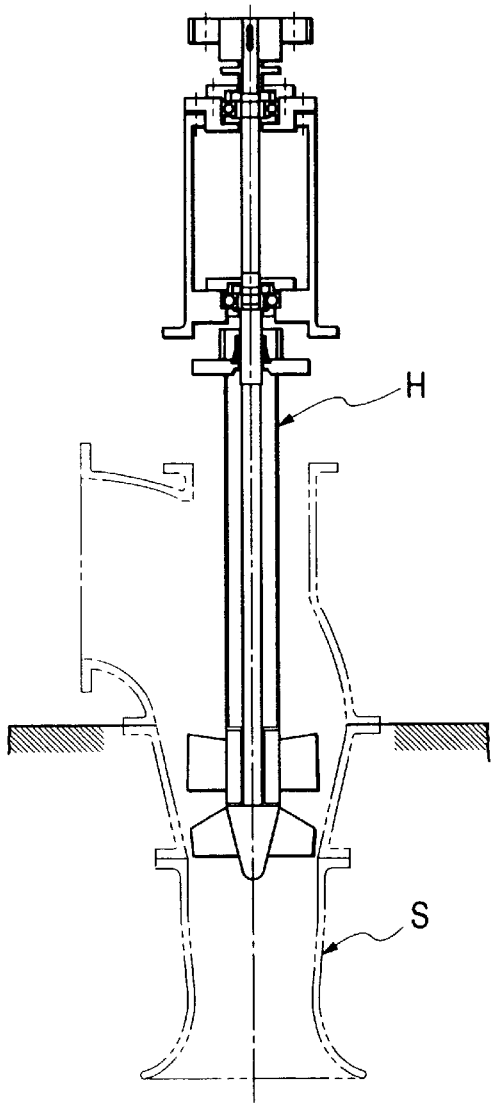
Figure 10A:
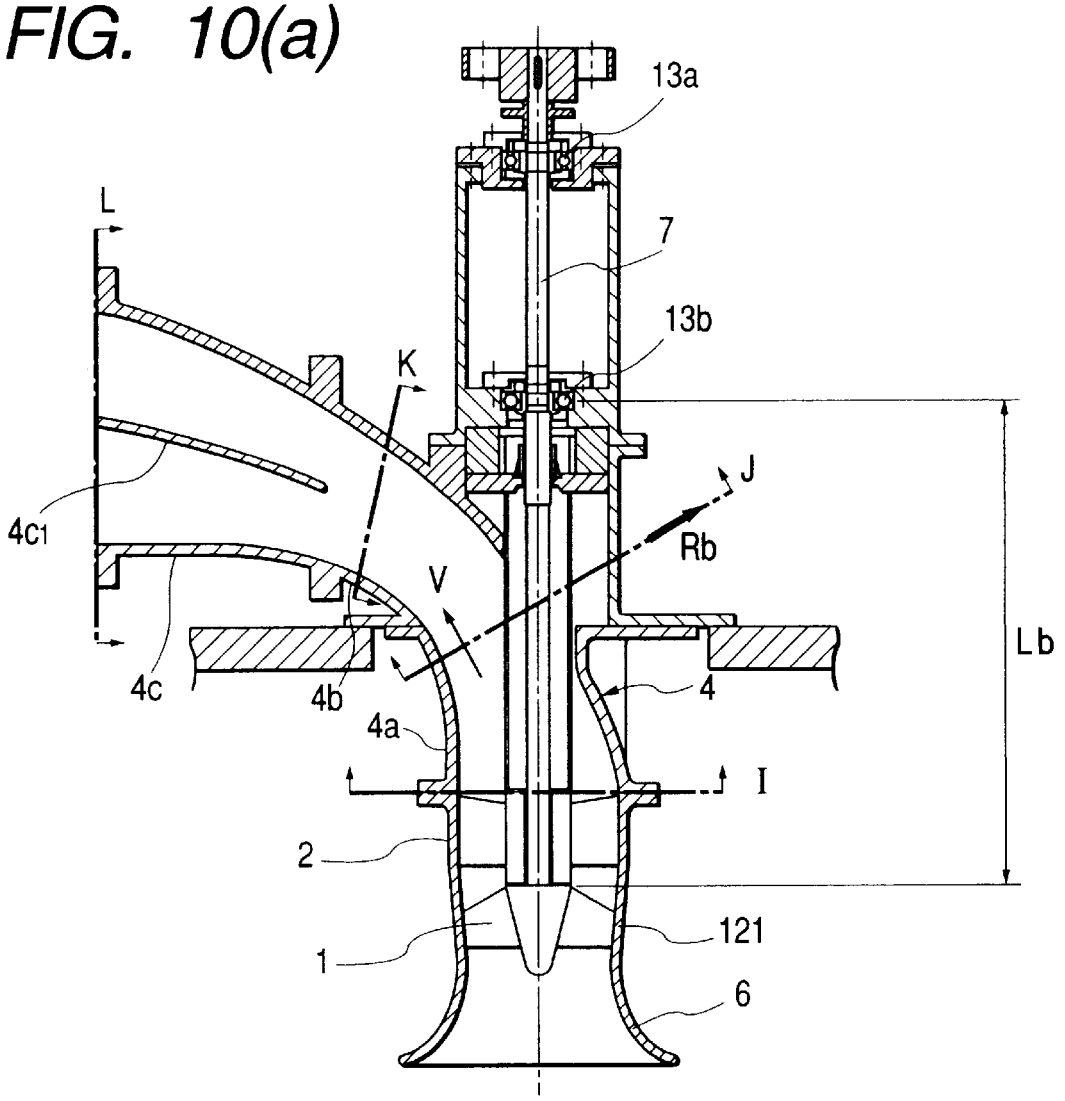
Figure 10B:
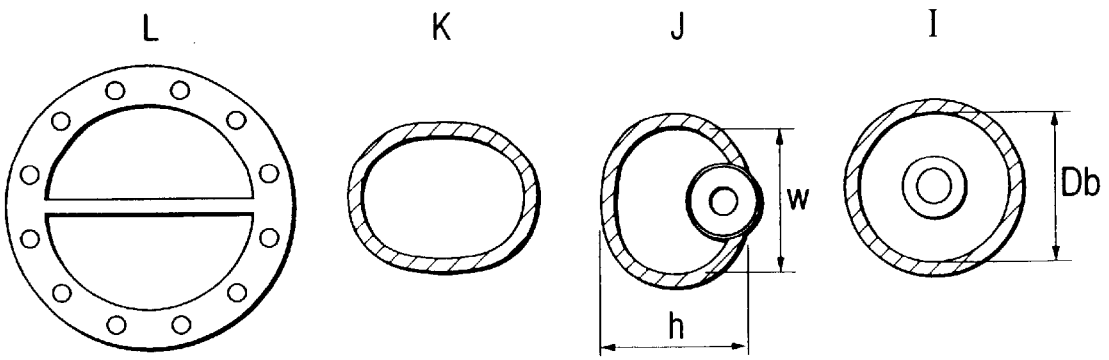
Figure 11:
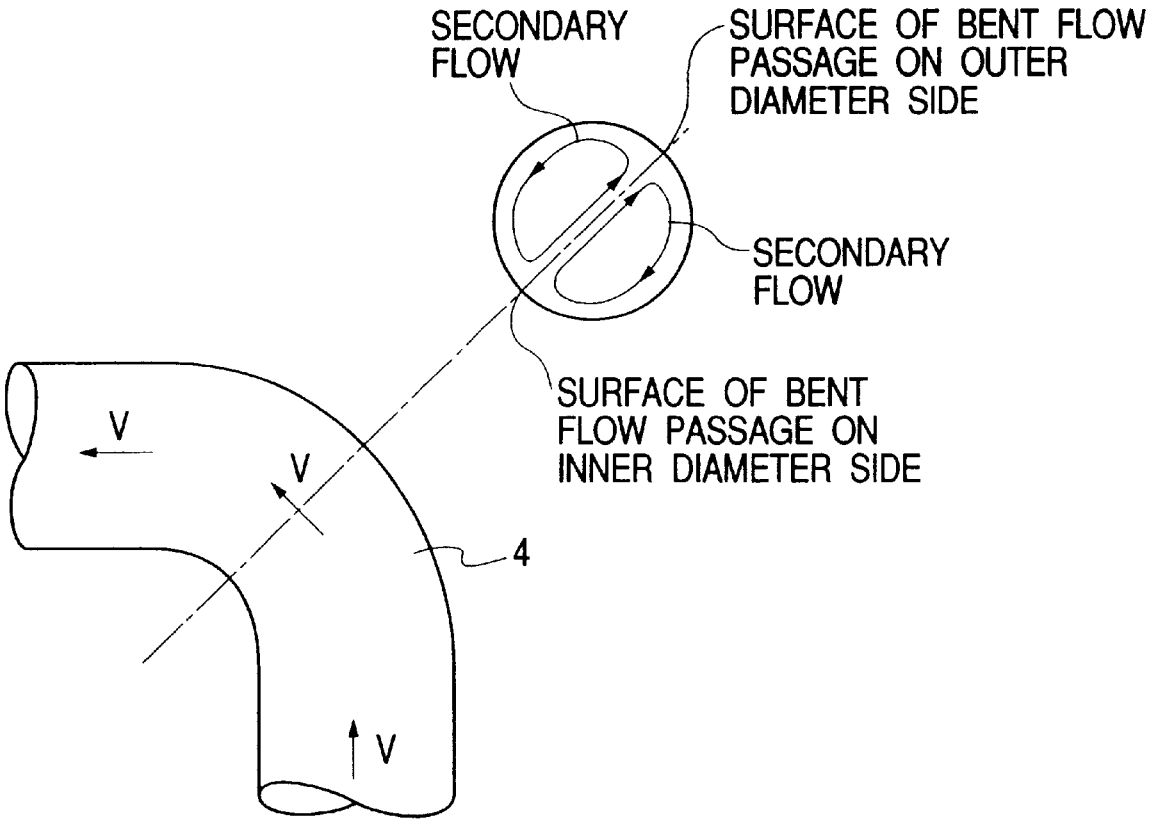
Figure 12A:
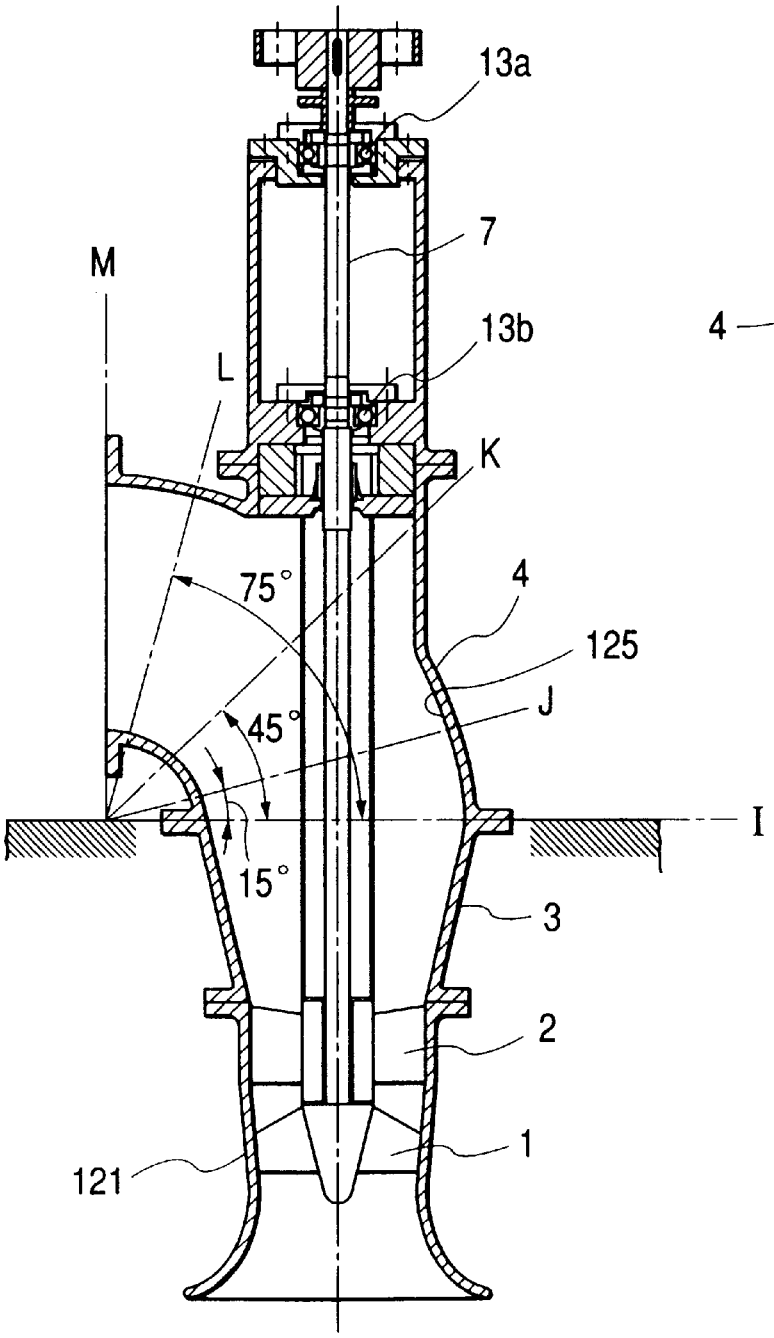
Figure 12B:
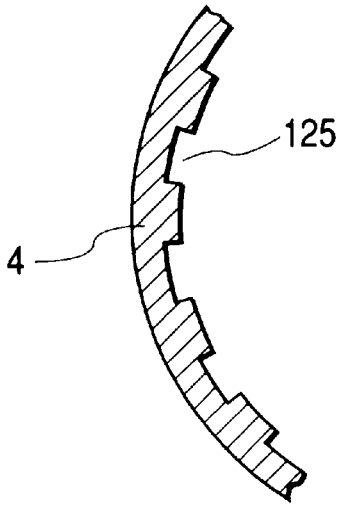

FIGS. 5(*a*) and 5(*b*) are views for showing the detailed construction of a portion of a rear guide vane 2 shown in the FIG. 2, and in particular, the FIG. 5(*a*) is a cross-section view of the essential portion thereof, while the FIG. 5(*b*) a view in the direction of b—b arrows;

FIGS. 6(*a*) and 6(*b*) are views for explaining velocity triangles of the pump impellers, and in particular, the FIG. 6(*a*) is for explaining the velocity triangle according to the conventional art, while the FIG. 6(*b*) the velocity triangle according to the present invention;

FIG. 7 is a vertical cross-section view for explaining an example of a mixed-flow pump, the length of which is shortened in an axial direction thereof by applying the present invention thereto;

FIGS. 8(*a*) and (*b*) are views for explaining the velocity triangles of the impeller in the embodiment shown in the FIG. 7;

FIGS. 9(*a*) and 9(*b*) are vertical cross-section views of a mixed-flow pump, for explaining an example thereof, being contrived to be easily made maintenance thereupon, by applying the present invention;

FIGS. 10(*a*) and 10(*b*) are views for showing an example, in which an improvement is made on a delivery bent shown in the FIGS. 9(*a*) and 9(*b*), and in particular, the FIG. 10(*a*) shows a vertical cross-section view thereof, while the FIG. 10(*b*) cross-sectional shapes at parts I, J, K and L in the FIG. 10(*a*);

FIG. 11 is a view for explaining a secondary flow in the portion of delivery bent; and FIGS. 12(*a*) and 12(*b*) are views for showing an example, in which a large number of grooves are formed on an interior wall surface of the delivery bent in the direction of flow therein, and in particular, the FIG. 12(*a*) shows a vertical cross-section, while the FIG. 12(*b*) a portion of the cross-sectional shape at the portion K in the FIG. 12(*a*).

DETAILED DESCRIPTION OF THE INVENTION

Hereinafter, embodiments according to the present invention will be fully explained by referring to the attached drawings.

FIG. 2 is a view for showing the structure of a typical vertical shaft mixed-flow pump, which is applied into a drainage pump, etc. Water in a suction water tank 9 is guided through a bell mouth 6, an open impeller 1 having no shroud, rear guide vanes 2 provided in an outlet side of the impeller 1, a delivery casing 3, a delivery bent 4, and a delivery tube 8, up to a delivery outlet. A reference numeral 7 indicates a pump shaft, and at a lower end of this pump shaft 7 is attached the impeller 1 mentioned above. Also, on the delivery bent 4 is provided a bearing 13 for supporting the pump shaft 7, and further within a hub 21 supported by the rear guide vanes 2 fixed on a pump casing 121 is provided an underwater shaft (not shown in the figure) for rotationally supporting the pump shaft.

With an outlet angle of blades of the impeller on the side of a shroud thereof, it is in general to apply an angle from about 15 degree to 30 degree thereto. This is for the purpose that an unstable portion "F" uprising at the right-hand side will not occur, like the head curve (i.e., the head-flow rate characteristic curve) 10 shown in the FIG. 3.

Figure 3:
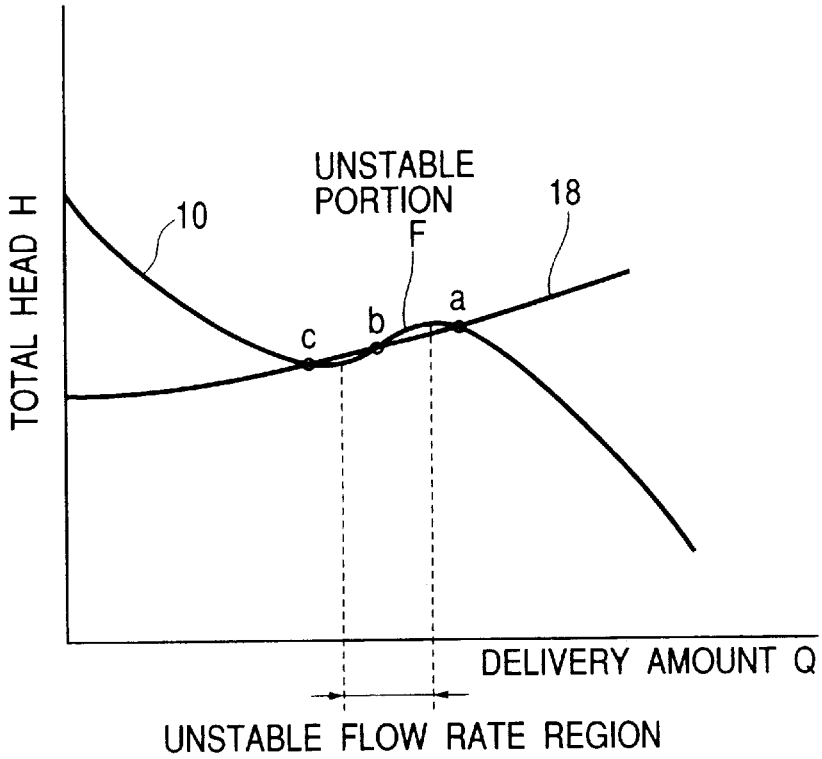
FIG. 3 is a graph for explaining a head-flow rate characteristic curve of a pump.

Namely, the load per a unit length of the blade is increased up when the blade outlet angle is made large, and there is a tendency that the unstable portion appears on the head curve (i.e., the uprising characteristic at the right-hand side) due to the separation and/or stalls in the region of the low flow rate, remarkably, as shown in the FIG. 3. Within a region of delivery amount where such the unstable portion appears, there exist the operating points (a, b, c) of the pump, more than two (2) as shown in the figure, and then the delivery amount is shifted between those points, therefore it is difficult to obtain the stable operation of the pump.

Then, according to the present invention, for the purpose of obtaining the small-sizing of the pump, but without the necessity of increasing up the revolution number of the impeller, while further suppressing the unstable portion appearing on the head curve due to the separation and/or stalls in the region of the low flow rate, the following measures are taken into. Namely, the outlet angle of blades of the pump impeller is set up to be larger than the conventional value, i.e., within a region being equal or greater than 30 degree and equal or less than 90 degree (i.e., in the angle measured from the periphery direction of impeller), and further a plural number of grooves are provided on an inner surface of the pump casing, connecting between the blade inlet side and an area on the inner surface of the casing where the blades exist. The blade outlet angle mentioned above is, by taking both the small-sizing of the pump and stabilization of the head curve thereof into the consideration, preferable to lies within a region from 50 degree up to 70 degree.

Theoretical head, which is generated by the pump impeller, is indicated by the following equation (Eq. 1).

$$H_{th} = \frac{(\pi n D_2)^2}{g} - \frac{nQ}{g b_2 \tan\beta_2} \quad \text{(Eq. 1)}$$

Where, $H_{th}$: the theoretical head, n: the revolution number (m/s), $D_2$: an outer diameter of the impeller, Q: the delivery amount ($m^3/s$), g: an acceleration of the gravity ($m/s^2$), $b_2$: a width of the outlet of the impeller, and $\beta_2$: the blade outlet angle of the impeller (deg). When obtaining the outer diameter of the impeller $D_2$ therefrom, the following equation (Eq. 2) can be obtained.

$$D_2 = \frac{1}{\pi n}\left(H_{th} + \frac{nQ}{g b_2 \tan\beta_2}\right)^{1/2} \quad \text{(Eq. 2)}$$

According to the above equation, in a case where the theoretical head $H_{th}$, the revolution number n and the outlet width of the impeller $b_2$ are constant, it can be seen that the outer diameter of the impeller $D_2$ can be made small if the outlet angle $\beta_2$ is large. In an ordinal pump according to the conventional art, the blade outlet angle of the impeller $\beta_2$ is applied to be a value within a range from 15 degree to 30 degree, however if, for example, the blade outlet angle of an averaged cross-section of the pump impeller is changed from 27 degree, being applied previously, to 52 degree, it is possible to reduce the outer diameter of the impeller down to 75%, and by converting into the cross-section area, the small-sizing of about ½ can be obtained in the sizes thereof.

Nevertheless, if applying such the large outlet angle to the impeller, the blade comes to be short and the load charged upon the blade is increased up. Accordingly, at the flow amount less than a design point (i.e., in a low flow rate region), an angle of incidence upon the blade comes to be large, therefore the separation and/or stalls occur easily. As a result of this, as shown in the FIG. 3, a concave occurs (in the vicinity of "c" portion in the figure) on the head curve 10 of the pump in the low flow rate region, thereby showing the unstable characteristic having such the portion uprising at the right-hand side on the head curve (in the vicinity of "b" portion in the figure).

However, according to the present invention, since the plural number of the grooves are provided on the inner surface of the pump casing, connecting between the blade inlet side and the area on the inner surface of the casing where the blades exist, it is possible to realize the stable head curve of descending or going-down at the right-hand side, with which the stable operation can be obtained even if a large outlet angle is applied to the impeller.

Hereinafter, explanation will be given on the embodiments of the present invention, in more details thereof.

Figure 1:
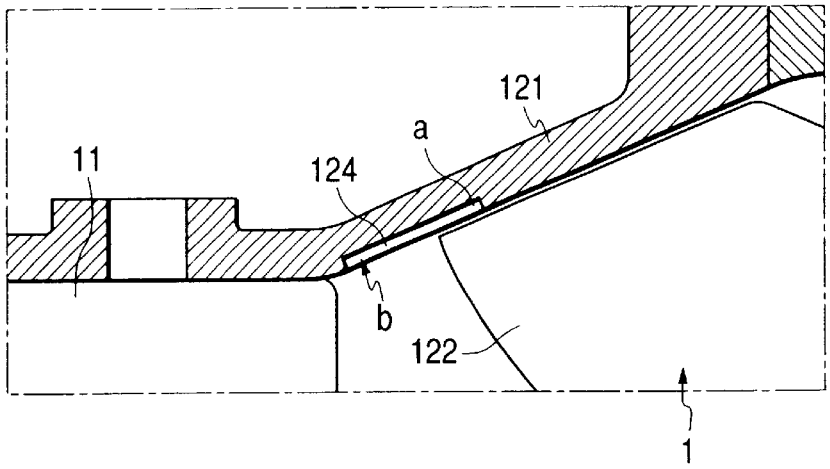
FIG. 1 is a cross-section view of an essential portion of a pump along a meridian plane thereof, for showing the structure of an embodiment according to the present invention, in particular in the vicinity of an inlet portion of an impeller.

FIG. 1 is an enlarged view for showing a portion "A" enclosed by a dotted chain line in the FIG. 2. In the vicinity of a front edge of the blade confronting to the impeller within the inner surface of the casing 121, plural numbers of shallow grooves are formed in the direction of pressure gradient of fluid around the periphery direction thereof, connecting between the blade inlet side and the area on the inner surface of the casing where the blades exist. With constructing in this manner, the pressure gradient of the fluid is formed in the direction from middle "a" of the blade 122 (at the position of terminal end of the groove in the downstream side) on the inner surface of the casing 121 to a position "b" where, re-circulations occur when the flow rate is low (at the position of terminal end of the groove in the upstream side). With this groove 124, the fluid increased up in pressure by the blade 122 flows within the groove 124 in reverse directing from the terminal position "a" of the groove in the downstream side to the terminal position "b" of the groove in the upstream side, so as to spout out at the position where the re-circulation occurs when the flow rate is low, thereby preventing the revolutions and/or stalls in revolution of the impeller due to the re-circulations of flow. Namely, a portion of the fluid increasing up in pressure by itself flows within the flow passages formed on the casing in the reverse direction, and spouts out at the position where the re-circulations occur, so as to suppress pre-swirls occurring in main flows at an inlet of the re-circulations and to suppress the generation of stalls in revolution of the blades, therefore it is possible to remove such the characteristic of uprising at the right-hand side from the head-flow rate characteristic curve, thereby stabilizing the head curve of the pump.

Figure 4:
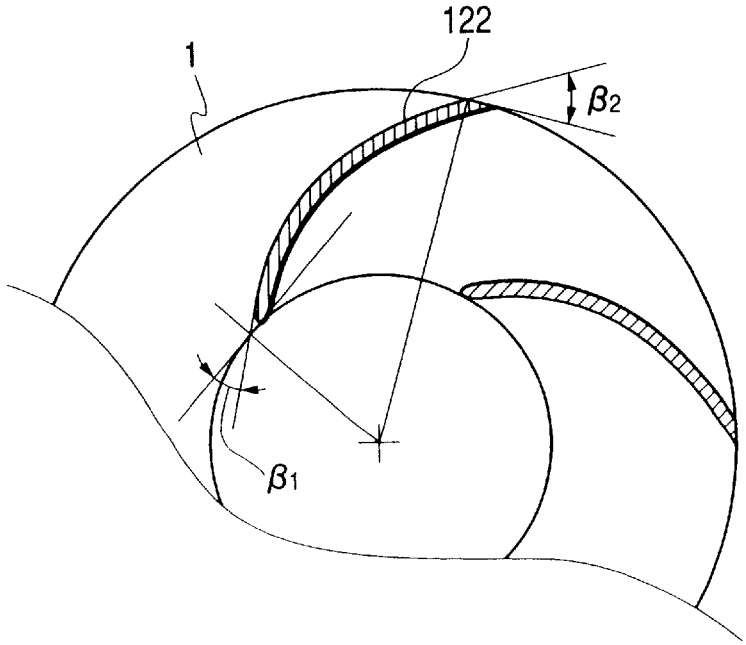
FIG. 4 is a view for explaining an outlet angle of blades of an impeller, in an embodiment of the pump according to the present invention.

Also, according to the present embodiment, as shown in FIG. 4, the outlet angle $\beta_2$ of the blade 122 of the impeller is set to be larger than the conventional one, from 15 degree to 25 degree, which is applied into the ordinary pump, i.e., at a value being equal or greater than 30 degree and less than 90 degree. For example, though conventionally an angle of about 27 degree is applied to the outlet angle of blade at an averaged diameter in an outlet of the impeller of the mixed-flow pump of a ratio velocity 1,200 (m, $m^3$/min, $min^{-1}$), however, according to the present invention, the outlet angle of blade of about 52 degree, being as about two (2) times large as that conventional value, is applied thereto. Then, the impeller is reduced down by 25% in the outer diameter thereof, therefore it comes down to about 75% in the size. This means, in a sense of the cross-section area of the pump, it comes down to be about a half (½) since it relates to the square thereof.

When the outlet angle b2 of blades of the impeller is set at a large value, the length of the blade from the inlet to the outlet of blade comes to be short, while the load upon the blade comes to be large (increase in the head per a unit of length of the blade), therefore the flow easily occurs the separation and stalls at the large angle of incidence. Namely, as shown in the FIG. 3, the concave portion uprising at the right-hand side in gradient, i.e., the unstable portion occurs in the low flow rate region on the head curve 10 of the pump. However, according to the present invention, as shown in the FIG. 1, with the provision of the shallow grooves 124 on the inner surface of the pump casing in the axial direction thereof, the unstable head curve is improved to be the stable one. Accordingly, since it is possible to obtain the stable head curve of descending at the right-hand side while suppressing the appearance of the unstableness on the head curve even when applying the large outlet angle b2, according to the present invention, it has an effect of obtaining a pump, which can be small-sized, without increase of the revolution number of the impeller, while suppressing the unstable portion appearing on the head curve due to the separation and/or stalls in the region of low flow rate. Accordingly, with the present invention, it is possible to reduce the outer diameter of the impeller (or the outer diameter of the pump) greatly, thereby realizing the small-sizing of the pump greatly.

Further, with the grooves 124 mentioned above, it is preferable to form the shallow grooves (it is preferable to make the depth of the groove smaller than the width thereof), each being 5 mm or more in the width, in large number thereof around the periphery direction, on the inner surface of the casing 121 confronting to an outer peripheral portion at the inlet side of blade of the impeller, while connecting between the place at the blade inlet side where the re-circulations occur when the flow rate is low and the area on the inner surface of the casing where the blades exist in the direction of pressure gradient of the fluid, and to locate the downstream side terminal position of the grooves at the position, so that the fluid can be taken out, being necessary for suppressing the generation of re-circulation at the upstream side terminal position of the grooves.

Preferable structure will be described on the above-mentioned grooves 124. Assuming that WR is a value (width ratio) obtained through dividing a total value of widths W of the grooves by the peripheral length of the casing at the portion of the grooves, VR (volume ratio) a value obtained through dividing the total volume of the grooves by the volume of the impeller, WRD (width-depth ratio) a value obtained through dividing the groove widths W by the groove depth D, and DLDR a ratio between the length of the groove from the blade inlet to the downstream and the depth of the groove, then an index for determining the configuration of the grooves is obtained from the following equation as JE No., and it is preferable to form the grooves in such the configuration that the index JE No. lies within a range from 0.03 to 0.5, and in more preferably from 0.15 to 0.2.

$$JE\ No. = WR \times VR \times WDR \times DLDR$$

For example, it is preferable to form the grooves 124 mentioned above, so that the width is equal or greater than 5 mm and the total widths of the grooves provided around the periphery in plural numbers thereof is around from 30% to 50% with respect to the periphery length on the inner surface of the casing where the grooves exist, while the depth of the grooves is equal or greater than 2 mm and lies within a range from about 0.5% to 1.6% of the diameter of inner surface of the casing where the grooves exist.

Further, with provision of a groove(s) in the peripheral direction for connecting the grooves in the above-mentioned axial direction (i.e., the direction of pressure gradient) in the peripheral direction, on the inner surface of the casing in the vicinity of the blade inlet, it is also possible to suppress the generation of noises, which occur easily because of the above-mentioned grooves in the axial direction.

FIGS. 5(*a*) and 5(*b*) are views for showing details of the structure of a portion of the rear guide vane 2 shown in the FIG. 2. In the hub 21 provided in the downstream side of the impeller 1 are provided the guide vanes 2(2*a*, 2*b*) mentioned above, and on a guide vane attachment surface (a hub surface 21*a*) of the hub 21 are provided intermediate vanes (small vanes or ribs) 20 having vane height of one-third (⅓) or less of the height of the guide vanes 2, between the rear guide vanes (2*a*, 2*b*). In FIGS. 6(*a*) and 6(*b*) showing velocity triangles at an outlet of the impeller, comparing to the general blade outlet angle $\beta_{2c}$, according to the conventional art, such as being from 15 degree to 25 degree (see is the FIG. 6(*a*)), when $\beta_2$ is made large, for example, being 52 degree (see is the FIG. 6(*b*)), in the present embodiment, a component $C_{u2}$ of an absolute velocity in the peripheral direction comes to be large at the outlet of the impeller. Because of this, a deflection angle necessary for the guide vanes 2 comes to be large from $\alpha_{2C}$ to $\alpha_2$, and then the load upon the guide vanes 2 also comes to be large. On a while, the guide vane 2 is a kind of a bent diffuser, therefore the flow is separated on the side of the hub 21 when the load is large, thereby sometimes accompanying an increase of loss therewith. The above-mentioned intermediate vanes 20 function to avoid it, effectively. Namely, the intermediate vanes 20 have functions of lightening or reducing the load upon the guide vanes at the side of hub, and enlarging a chord-node ratio at the side of hub and the guide effect of the flow, thereby suppressing the generation of separation and the increase of loss. Accordingly, according to the present embodiment, it is possible to escape from the increase of loss even if applying the large outlet angle onto the blade 122, so as to obtain high efficiency.

FIG. 7 shows an example, in which the pump is shortened in length of the axial direction thereof, by applying the present invention therein. Also in this example, on the inner surface of the casing confronting to the vicinity of the front edge of the impeller are provided the shallow grooves 124, in the same manner as shown in the FIG. 1. In general, in the pump, for the purpose of recovering dynamic pressure at the outlet of the impeller into static pressure, the rear guide vanes 2 (see the FIG. 2) are provided in the downstream side of the impeller. On the contrary to this, in this embodiment, front guide vanes 11 are provided on the inner surface of the casing 121 in a front (i.e., the upstream side) of the impeller. The function of these front guide vanes 11 is not to recover the dynamic pressure into static pressure, but to increase the velocity of the flow, as well as to convert it. Further, it is also possible to provide the underwater bearing made of ceramics on the central portion side of the front guide vanes 11 fixed on the casing, thereby constructing it to support a lower end portion 7*a* of the pump shaft 7 by this underwater bearing.

The velocity triangles of the front guide vane 11 and the blade of the impeller are shown in FIGS. 8(*a*) and 8(*b*). The velocity triangles shown by broken lines indicate those in a case where no front guide vane is provided but only the rear guide vanes, while the velocity triangles shown by solid lines those in a case where the front guide vanes 11 are provided as shown in the FIG. 7. In the case of the front guide vanes, the flow to be run into the impeller is increased up to $C_1$ in the velocity and converted by the guide vanes, and then it flows into the impeller at a relative velocity $W_1$, while it is reduced down in the velocity within the impeller, so as to flow out at a relative velocity $W_2$. As shown in those figures, the absolute velocity $C_2$ at the outlet of the impeller is directed into the axial direction, therefore there is no necessity for the flow to be decelerated by the rear guide vanes in the downstream side of the impeller, in order to recover the pressure. In this manner, setting the front guide vanes provided in the casing at the upstream side of impeller, so that the absolute flow at the outlet of the impeller is directed into the axial direction of the pump at the design flow amount, necessitates no such the rear guide vanes are unnecessary, therefore it is possible to make the pump short in the axial length thereof.

Further, the front guide vanes are lines of vanes for increasing up the velocity, and in general, they can make the loss small, by comparing to those of the rear guide vanes for decelerating the velocity. Accordingly, the length of the front guide vanes 11 can be set short in the axial direction thereof. Also, since the guide vanes can be provided in the existing flow passage between the bell mouth 6 and the impeller 1, the main portions of the pump, including the bell mouth 6 of the pump, the guide vanes 11 and the impeller 1, can be made short in the length of the axial direction thereof, substantially, by the portion of the rear guide vanes 2, comparing to the case where the rear guide vanes 2 are provided.

Also, as is apparent from the FIGS. 8(*a*) and 8(*b*), in the velocity triangles at the inlet of blade, a relative inflow angle $\beta_1$ into the blades of the impeller becomes smaller comparing to the conventional inflow angle $\beta_{1C}$. Also, in the velocity triangles at the outlet of blade, also an outflow angle $\beta_2$ at the outlet of blade comes to be smaller comparing to the conventional $\beta_{2C}$. Accordingly, it is possible to establish or set up the blade length of the impeller to be long, and the load is lightened comparing to the conventional impeller, therefore the capability is lowered in occurring such the unstable portion on the head curve. Further, even in a case where the unstable portion occurs on the head curve, for example, the head curve is stabilized due to the effect of the grooves 124 provided on the casing.

As was mentioned in the above, according to the present embodiment, it is possible to shorten the pump in the length of axial direction, greatly, and at the same time, to obtain the stable head curve thereby.

FIGS. 9(*a*) and 9(*b*) show examples, in which the pump is devised so that maintenance can be performed easily, by applying the present invention therein. Namely, a hydraulic power portion H is built up, by assembling the impeller 1, the guide vanes 2, the shaft portion 7, a shaft protection tube 12 and the bearing portion 13 (an upper bearing 13*a*, and a lower bearing 13*b*) in one body, and it is inserted from above into a flow passage forming member (a fixed flow passage portion) S constructed with the bell mouth 6, the casing 121, the delivery tube 3, the delivery bent 4, etc., thereby being so constructed, that the hydraulic power portion can be assembled or disassembled freely, as shown in the FIG. 9(*b*). In this embodiment, in the same manner as in the above, the plural numbers of the shallow grooves 124 mentioned above are formed on the inner surface of the casing 122 confronting to the blades of the impeller, and the blades of the impeller are so established that they have a large outlet angle.

In this manner, i.e., the hydraulic power portion H and the fixed flow passage portion S are divided, so that hydraulic power portion can be removed outside from the flow passage forming member provided fixedly as a part in one body, then it is possible to take out the hydraulic power portion, in particular having a large necessity to be taken out for inspection, maintenance, repairs, etc., outside the pump, easily, even after installing the pump into a drainage station, etc., thereby enabling the maintenance work to be made very easily.

And, with the examples of the FIGS. 9(*a*) and 9(*b*), it is also possible to eliminate the underwater bearing at the side of the impeller, thereby constructing it so that the shaft is supported by only two (2) air bearings 13(13*a*, 13*b*) provided on the side of a motor. This is applicable structure, since it is possible to enlarge the length in the axial direction for overhanging from the above-mentioned bearing 13 because of the small-sizing and/or weight lightening of the impeller obtained according to the present invention. With elimination of the underwater bearing, it is possible to improve the reliability of the pump when it is operated in the air remarkably, and also, since there is no necessity of provision of the expensive underwater bearing, such as the ceramics bearing, etc., it is possible to obtain reduction in the cost of the pump.

Furthermore, with the structure in which the front guide vanes 11 are provided, as was shown in the FIG. 7, since the length of the pump can be further shorten in the axial direction thereof, it is possible to adopt the structure abolishing the underwater bearing therein, with much ease.

Functions of the embodiment mentioned above will be explained. A portion of the liquid increased in pressure by the impeller runs in the grooves 124 formed on the casing in the direction of pressure gradient, toward the upstream side in the reverse direction, and spouts out at the position where the re-circulations occur. Namely, the flow without circulation therein from the grooves 124 suppresses the swirl components formed by the reverse flow (i.e., the re-circulations), thereby enabling the suppression of the pre-swirls which occur within the main flow running into the impeller. With this, since the generation of stalls in the rotation of blades is suppressed, it is possible to suppress the characteristic of uprising at the right-hand side to appear on the head-flow rate characteristic curve of the pump, thereby obtaining the stable head curve of descending or going-down at the right-hand side.

Also, it is possible to make the pump small in the sizes thereof, by applying the large angle value (from 30 degree to 90 degree) onto the outlet angle of blades of the impeller, but without increase in the revolution number of the pump. Furthermore, with adoption of the front guide vanes 11, it is also possible to shorten the total length of the pump, greatly.

Further, with such the structure of the pump, in which it is divided into the hydraulic power portion formed by assembling the parts, including the impeller, the guide vanes and the bearing, being formed in one body, and the flow passage-forming member other than that, including the delivery tube, the delivery bent, the casing, etc., it is possible to perform the maintenance and/or inspection, etc., on the pump, with ease.

Furthermore, since the impeller can be made small-sized and light-weighted, it is possible to construct it to be overhung by the two (2) bearings 13*a* and 13*b* at the side of the motor, and with this, there is no necessity of provision of such the expensive underwater bearings, and further it is possible to operate the pump in the air.

However, when the outlet angle of blade is made equal or larger than 30 degree in the manner of the present invention, the flow velocity within the pump comes to be fast, and then it easily causes an increase in the flow loss, thereby easily causing a reduction in the efficiency. Effective means for solving this will be explained by referring to FIGS. 10 to 12.

FIGS. 10(*a*) and 10(*b*) show examples, in which an improvement is made onto the delivery bent 4 shown in the FIGS. 9(*a*) and 9(*b*). The delivery bent 4 is divided into three portions, i.e., a vane side portion 4*a*, a bent portion 4*b*, and a delivery side portion 4*c* provided in the horizontal direction, directing from the outlet side of the guide vanes 2 to the delivery outlet thereof, and each portion is connected by a flange, thereby to form the bent passage. The shapes on the cross-section at the portions I, J. K and L in the FIG. 10(*a*) are shown in the FIG. 10(*b*). In the figures showing the respective cross-section shapes of the delivery bent, the left-hand side in the figure indicates an inner diameter side of bending in the delivery bent. On the shape at the cross-section J in the vicinity of the center of the bending of the passage, width "h" of the flow passage in the direction of curvature radius "Rb" of the bent tube is set up to a value being smaller than the width "W" of the flow passage in the direction perpendicular to the curvature surface (i.e., in the direction perpendicular to the radius direction Rb), so that it satisfies a relationship, for example, W=(1.3~2.0)h. Also, it is desirous to set up the area of the cross-section of the flow passage, at the cross-section in the vicinity of the center of the curvature of passage of the above-mentioned delivery bent, being as from 1.0 time to 1.2 times large as the cross-section area of the inlet portion of the delivery bent. The "L" portion on the cross-section at the outlet of the bent tube is constructed with a circle-like cross-section. The cross-section shape at the "K" portion is formed, so that the circle-like cross-section of the "L" portion and an oval shape of the cross-section "J" in the vicinity of the center of curvature are continuously changed to be connected with each other smoothly. At the delivery side portion 4*c* of the bent tube, the flow passage is enlarged from the cross-section "K" of the oval shape to the cross-section "L" of the circle-like shape, therefore the flow is decelerated therein. In the flow passage between those, the area of the flow passage is enlarged by from 1.2 times to 2.0 times. For the purpose of shortening the length of flow passage, but not enlarging the cross-section of the passage too much, a plate-like flow straightening plate 4*c*1 is inserted in a center on the cross-section of the flow passage.

With the pump being structured in this manner, in the vicinity of the cross-section "J" near to the center of curvature of the delivery bent 4, the width "h" of flow passage defined by the inner diameter side surface 4*b*1 and the outer diameter side surface 4*b*2 is formed to be smaller than an inner diameter of the ordinary bent, i.e., the diameter "Db" at the bent inlet. Therefore, in the vicinity of the cross-section "J", with centrifugal force Fc acting on the flow "V" passing through the bent portion, the difference in the centrifugal forces acting upon the inner diameter side 4*b*1 of the curvature and the outer diameter side 4*b*2 of the curvature comes to be small comparing to that in the normal case, since the radial difference of the curvature of the flow passage is small.

On a while, in a case where the flow passage is constant in the area at the outlet and the inlet thereof, namely, there is no deceleration nor acceleration in the flow within the flow passage, because of the difference between the inner and outer diameters due to the curvature, a difference occurs in the centrifugal forces acting upon the flow, and due to this difference in the centrifugal force, a secondary flow occurs as shown in the FIG. 11. The loss in hydraulic power within the curved flow passage is mainly the loss due to this secondary flow. Accordingly, as shown in the FIGS. 10(*a*) and 10(*b*), if the flow passage is formed, so that the difference between the inner and the outer diameters is small in the curvature thereof, then the difference comes to be small in the centrifugal forces acting upon the flows in the inner and outer diameter portions, and as a result of this, the secondary flow comes to be small, therefore it is possible to make the loss due to the secondary flow small.

Also, with the provision of the flow straightening plate 4*c*1 in the bent portion 4*c*, the flow passage is prevented from being enlarged abruptly, and then it is possible to convert the velocity energy of the flow into the pressure energy, while suppressing the enlarged loss to be small. As a result of this, it is possible to obtain the small-sizing of the pump without decrease in the efficiency of the pump.

With such the pump being small-sized by setting up the outlet angle of blade to be large, as the pump according to the present invention, the loss comes to be large easily due to increase in the flow velocity within the flow passage. Accordingly, if applying such the bent tube as mentioned in the above, the increase of the loss in the delivery bent can be suppressed, therefore it is possible to obtain the efficiency being equal or greater than that of the conventional pump.

Also, as shown in the FIGS. 10(*a*) and 10(*b*), a distance "Lb" in the axial direction between the impeller 1 and the bearing 13(13*b*), i.e., the overhang length of the shaft, can be set up to be small, greatly, comparing to that in the case of the conventional pump. As a result of this, it is also possible to obtain a scale-down in the shaft diameter of the pump, as well as reduction in height for setting-up of the motor, etc., thereby achieving reduction in the manufacturing costs of the pump.

FIGS. 12(*a*) and 12(*b*) show an example, in which large numbers of the grooves 125 are formed on the wall of inner surface of the delivery bent 4. The grooves are formed so that geometric parameters, such as the depth, the width, and the number of pieces thereof comes to be from 0.03 to 0.5 in the JE No. mentioned above. The grooves 125 are provided on the wall of flow passage between from the cross-section portion "I" at the inlet of the delivery bent to the cross-section portion "M" at the outlet thereof. Or, it is desirous to form them at least from the "J" portion to the "L" portion (in the vicinity of the center of the curvature portion) in the FIG. 12(*a*). Further, in this embodiment shown in the FIG. 12(*a*), the delivery casing 3 is provided between the pump casing 121 of the impeller portion and the delivery bent 4, and the portion of this delivery casing 3 is constructed in a conical and trapezoidal shape (i.e., a tapered shape having an area of flow passage being enlarged in the direction to the downstream side).

In the delivery bent 4 constructed in this manner, the secondary flow or the like, which is caused by the swirl component remaining within the flow flowing therein and the function of the centrifugal force in the bending, is guided into the direction of the main flow through the grooves 125, therefore the velocity component flowing in the peripheral direction within the flow passage is reduced. As a result of this, the loss due to the secondary flow is reduced, thereby maintaining the high pump efficiency. Also, by making the portion of the delivery casing 3 into the conical and trapezoidal shape, it is possible to bring the pump as a whole to have high efficiency and to be compact in the scale.

With the pump according to the present invention, in which the shallow grooves are formed on the inner surface of the casing confronting to the impeller, in the direction of pressure gradient of fluid in the plural numbers thereof, and further the blade outlet angle of the impeller is made large in the structure thereof, it is possible to obtain an effect of achieving the small-sizing of the pump greatly, but without increasing up the revolution number thereof, while preventing the head curve from causing the unstable characteristic thereon, by suppressing the pre-swirl due to the re-circulations at the inlet portion of blades.

While we have shown and described several embodiments in accordance with our invention, it should be understood that the disclosed embodiments are susceptible of changes and modifications without departing from the scope of the invention. Therefore, we do not intend to be bound by the details shown and described herein but intend to cover all such changes and modifications falling within the ambit of the appended claims.

What is claimed is:

1. A pump, comprising:

an impeller having blades; and a casing for storing said impeller therein, on an inner surface of which, confronting to said impeller, are formed a plurality of grooves in a direction of pressure gradient of fluid, around a periphery thereof, for connecting between an inlet side of blades and an area on the inner surface of said casing where the blades exist, wherein, an outlet angle of the blade, being measured from a peripheral direction of the blade of said impeller, is set to be within a region from 50 degrees to 90 degrees.

2. A pump, as defined in the claim 1, wherein said outlet angle of the blade is set to be within a region from 50 degree to 70 degree.

3. A pump, as defined in the claim 1, wherein a plurality of rear guide vanes are provided around a periphery of a hub which is provided at the outlet side of said impeller, and on a surface of said hub are provided intermediate vanes, having a height being equal to or less than one-third (⅓) of that of the rear guide vanes, between said rear guide vanes.

4. A pump, as defined in the claim 1, wherein said pump is a vertical shaft pump having a flow passage forming portion which is constructed with a pump casing and a delivery bent, and a pump shaft, which penetrates through said delivery bent vertically and is attached with the impeller at a lower side thereof.

5. A pump, as defined in the claim 4, wherein at least two bearings are disposed on said delivery bent spaced in a vertical direction, for supporting said pump shaft, and are so arranged that a distance between an attachment portion of said impeller onto the pump shaft and an upper portion of a lowermost bearing of said at least two bearings is larger a distance between said at least two bearings.

6. A pump, as defined in the claim 5, further comprising a hub provided at an outlet side of said impeller, and rear guide vanes provided on the hub, wherein said impeller, said hub, said rear guide vanes said pump shaft and said at least two bearings are assembled together in one body as a hydraulic power portion, and being so constructed, that said hydraulic power portion can be assembled with or disassembled from the flow passage forming member which is constructed with the pump casing and the delivery bent, by inserting said hydraulic power portion into said flow passage forming member from above.

7. A pump comprising:

a casing;

an impeller having a plurality of blades, being provided within said casing; and a plurality of grooves, which are provided on an inner surface of said casing, connecting between an inlet side of said impeller and an area on the inner surface of said casing where the blades exist, wherein, front guide vanes are provided in said casing at an upstream side of said impeller, and said front guide vanes are so set up, that a direction of absolute flow at an outlet of said impeller is directed into an axial direction of the pump at an amount of designed flow rate.

8. A pump, as defined in the claim 7, wherein an outlet angle of said impeller is set up to be equal or greater than 30 degree.

9. A vertical shaft pump, comprising:

a pump casing;

an impeller having a plurality of blades, being provided within said casing;

a delivery bent disposed in a downstream side of said pump casing;

a pump shaft, penetrating through said delivery bent vertically and being attached with the impeller at a lower side thereof; and a plurality of grooves, which are provided on an inner surface of said casing, connecting between an inlet side of said impeller and an area on the inner surface of said casing where the blades exist, wherein said grooves are formed to be equal or greater than 5 mm in depth thereof, while to be smaller than the depth in width of said grooves;

an outlet angle of the blade is set to be within a region from 30 degree to 90 degree; and said delivery bent is formed in an oval shape in cross-section thereof, in which difference between inner and outer diameters of a curvature is smaller than width of a flow passage therein, on a cross-section in vicinity of the curvature of said flow passage.

10. A vertical shaft pump, as defined in the claim 9, wherein a shape on the cross-section of said delivery bent is a circular shape on the cross-section at an inlet side and an outlet side thereof.

11. A vertical shaft pump, as defined in the claim 9, wherein width h of the flow passage in a curvature radial direction Rb of said bent tube is set up to establish following relationship $$W=(1.3\sim2.0)h$$

where W is the width of the flow passage in a direction perpendicular to a plane of the curvature said plane of curvature being perpendicular to the radius direction Rb, in a cross-sectional shape of said delivery bent on a cross-section, in vicinity of a center of the curvature of the flow passage thereof.

12. A vertical shaft pump, as defined in the claim 9, wherein cross-section area of the flow passage on a cross-section of said delivery bent in vicinity of a center of the curvature of the flow passage thereof is as from 1.0 time to 1.2 times large as cross-section area at an inlet portion of said delivery bent.

13. A vertical shaft pump, as defined in the claim 9, wherein a plurality of grooves are formed on an inner wall surface of said delivery bent in a direction of main flow therein.

* * * * *